US007513085B2

(12) United States Patent
Moody et al.

(10) Patent No.: US 7,513,085 B2
(45) Date of Patent: Apr. 7, 2009

(54) METAL TRUSS

(75) Inventors: Donald R. Moody, Denton, TX (US); Courtney J. Hanson, Denton, TX (US); Hamilton Lott, Charlotte, NC (US)

(73) Assignee: Nucon Steel Corporation, Denton, TX (US)

( * ) Notice: Subject to any disclaimer, the term of this patent is extended or adjusted under 35 U.S.C. 154(b) by 49 days.

(21) Appl. No.: 10/693,541

(22) Filed: Oct. 24, 2003

(65) Prior Publication Data

US 2005/0086893 A1 Apr. 28, 2005

(51) Int. Cl.
*E04B 1/32* (2006.01)

(52) U.S. Cl. ..... 52/639; 52/635; 52/636; 52/648.1

(58) Field of Classification Search ..... 52/648.1, 52/634, 635, 636, 639, 652.1, 651.06, 406.1, 52/407.1, 407.5, 404.2, 794.1
See application file for complete search history.

(56) References Cited

U.S. PATENT DOCUMENTS 1,311,486 A 7/1919 Benedict
1,367,289 A * 2/1921 Waller ..... 52/639
1,747,313 A 2/1930 Miss
1,924,880 A 8/1933 Ragsdale
1,925,769 A 9/1933 McAvoy et al.
1,963,184 A 6/1934 Webster
2,067,403 A 1/1937 Lea
2,166,943 A * 7/1939 Davison ..... 52/519
2,210,026 A 8/1940 Connors, Jr.
2,234,960 A 3/1941 Buelow
2,262,120 A * 11/1941 Smits ..... 52/639
2,329,041 A 9/1943 Ford (Continued)

FOREIGN PATENT DOCUMENTS

CA 476296 8/1951

(Continued)

OTHER PUBLICATIONS

"Residential Steel Framing—In-Depth Analysis", ToolBase Services—The Home Building Industry's Technical Information Resource, pp. 1-7, http://www.toolbase.org/tertiaryT.asp?DocumentID=2163&CategoryID=1142.

(Continued)

*Primary Examiner*—Richard E. Chilcot, Jr.
*Assistant Examiner*—Jessica Laux
(74) *Attorney, Agent, or Firm*—Michael G. Johnston; Moore & Van Allen PLLC

(57) ABSTRACT

A metal truss comprises elongated top chord members connected to each other at their ends. A first elongated bottom chord member is connected at its ends to the top chord members adjacent the free ends of the top chord members. A second elongated bottom chord member is connected at its ends to the top chord members, or directly to the first bottom chord member via spacers, such that the second bottom chord member is spaced below the first bottom chord member. At least one web member is positioned between and interconnecting at least one top chord member and the first bottom chord member. One end of the web member is connected to the at least one top chord member and the other end of the web member is connected to the first bottom chord member.

17 Claims, 6 Drawing Sheets

U.S. PATENT DOCUMENTS 2,385,142 A * 9/1945 Lank ..... 52/639
2,541,784 A 2/1951 Shannon
2,624,430 A 1/1953 Macomber
2,630,890 A 3/1953 Macomber
2,642,825 A 6/1953 McElhone et al.
2,687,102 A 8/1954 Rongved et al.
3,029,914 A 4/1962 Macomber
3,160,987 A * 12/1964 Pinkley ..... 52/95
3,227,062 A * 1/1966 Andersson ..... 454/253
3,429,091 A * 2/1969 Dundr ..... 52/639
3,541,749 A 11/1970 Troutner
3,583,121 A 6/1971 Tate et al.
3,651,612 A 3/1972 Schmitt
3,656,270 A 4/1972 Phillips
3,668,828 A 6/1972 Nicholas et al.
3,686,819 A 8/1972 Atkinson
3,785,108 A * 1/1974 Satchell ..... 52/645
3,882,653 A 5/1975 Ollman
3,961,455 A 6/1976 Peters
4,074,487 A 2/1978 Daniels et al.
4,141,191 A 2/1979 Aarons
4,159,604 A 7/1979 Burrell
4,295,312 A 10/1981 Campbell
4,329,827 A * 5/1982 Thorn ..... 52/790.1
4,389,829 A 6/1983 Murphy
4,414,787 A * 11/1983 Kappen ..... 52/643
4,435,940 A 3/1984 Davenport et al.
4,483,118 A 11/1984 Betschart
4,530,191 A 7/1985 Boisbluche
4,615,157 A 10/1986 Murray
4,616,453 A 10/1986 Sheppard, Jr. et al.
4,669,243 A * 6/1987 Gore et al. ..... 52/696
4,720,958 A 1/1988 Wiklund
4,748,784 A * 6/1988 Dividoff et al. ..... 52/639
4,827,688 A 5/1989 Tene
4,858,398 A 8/1989 Ricchini
4,863,189 A 9/1989 Lindsay
4,907,390 A 3/1990 Tene
4,943,038 A 7/1990 Harnden
4,982,545 A 1/1991 Stromback
5,337,533 A * 8/1994 Kajita ..... 52/741.1
5,454,201 A * 10/1995 Slonim ..... 52/639
5,526,628 A 6/1996 Knudson
5,542,227 A * 8/1996 Frayne ..... 52/639
5,553,375 A 9/1996 Powers
5,577,353 A 11/1996 Simpson
5,649,403 A 7/1997 Haisch
5,651,230 A 7/1997 Knudson
5,873,567 A 2/1999 Williams
5,983,589 A 11/1999 Daudet
6,079,174 A 6/2000 Williams et al.
6,237,297 B1 5/2001 Paroly
6,253,521 B1 7/2001 Gavin et al.
6,260,327 B1 * 7/2001 Pellock ..... 52/643
6,272,447 B1 8/2001 Gavin et al.
6,349,518 B1 * 2/2002 Chacko ..... 52/404.1
6,354,056 B1 3/2002 Korzen
6,560,858 B1 5/2003 McAdoo
6,843,718 B2 * 1/2005 Schmitz ..... 454/186
6,976,337 B2 * 12/2005 Hiraki ..... 52/79.1
2001/0044707 A1 11/2001 Gavin et al.
2002/0005022 A1 1/2002 Matthews
2002/0059774 A1 5/2002 Collins
2002/0073889 A1 6/2002 Khattab et al.
2002/0078655 A1 6/2002 Montanaro et al.
2004/0000113 A1 * 1/2004 Alderman ..... 52/407.5
2004/0211146 A1 * 10/2004 Weeks ..... 52/633
2005/0279039 A1 * 12/2005 Konopka ..... 52/407.1

FOREIGN PATENT DOCUMENTS

GB 1 257 031 12/1971
WO PCT/AU88/00188 6/1988
WO PCT/AU/96/00251 5/1996

OTHER PUBLICATIONS

Don Allen, "Residential Steel Framing Becomes Easier, Faster and Chepater To Use", pp. 1-2, http://www.fhba.com/homebuilder/marchapril100/steelframing.htm.
Timothy J. Waite, P.E., "What's Ahead for Steel Frame Construction", Walls & Ceilings, Sep. 9, 2002, pp. 1-4, http://www.wconline.com/wc/cda/articleinformation/features/bnp__features__item/0,3299,83....
Don Allen, "The Puzzle of Steel", Walls & Ceilings, Oct. 18, 2000, pp. 1-4, http://www.wconline.com/wc/cda/articleinformation/features/bnp__features__item/0.3299.12999.00.html.
"Up Front Thermal Improvements", Walls & Ceilings, Sep. 10, 2002, pp. 1-2, http://www.wconline.com/wc/cda/articleinformation/features/bnp__features__item/0,329983....
"Gus Truss", pp. 1-3, http://www.premiumsteel.com/Products/GussTruss/page1.htm.
"The Gus Truss", Clark Engineering, p. 1, http://www.clarksteel.com/cl__catalog.htm.
"The Right Stuf: Universal Designator System for Light Gauge Steel Framing Members", www.steelframingalliance.com/codes/rightstuff.pdf.
"I-Beams Made by Connecting Two Channels", pp. 371-377.
"Inelastic Reserve Capacity of Beams", pp. 217-229.
"Design of Beam Webs", pp. 145-166.
"AISI Design Formulas For Flexural Buckling", pp. 235-243.
John Wyatt, "Steel Rail Blues", Walls & Ceilings, Sep. 9, 2002, p. 1-4, http://www.wconline.com/wc/cda/articleinformation/coverstory/bnpcoverstoryitem/0,3296,8....
The TrusSteel Story, p. 1-3, http://www.trussteel.com/TrsSteel.NSF/8525601a0077f5dc85255d7c00545af7/36147e250aa7e6f68625696e....
"SBA Changes to MBCEA", Modern Trade Communications, Sep. 20, 2002, p. 1-6, http://www.moderntrade.com/edit/news9-02.htm.
"Gus Trussu", p. 1-2, http://www.wmlinc.com/prod__GusTruss.htm.
Wei-Wen Yu, Ph.D., Cold-Formed Steel Design, 1985, pp. 1-5, 115-128, A Wiley-Interscience Publication, USA.
Wei-Wen Yu, Design of Light Gauge Cold-Formed Steel Structures, 1965, pp. 1-3, 23-26, 34-37, Engineering Experiment Station, US.
"Specification For The Design of Cold-Formed Steel Structural Members, Cold-Formed Steel Design Manual—Part I", American Iron And Steel Institute, Sep. 3, 1990, pp. 11-30.
"Specification For The Design of Cold-Formed Steel Structural Members, Cold-Formed Steel Design Manual—Part IV", American Iron And Steel Institute, Sep. 3, 1990, pp. 20-24, 39-40, 49-55, 81-85.
"Light Gage Cold-Formed Steel Design Manual", American Iron and Steel Institute, 1962 Edition, pp. 38-57, 81-83, 96-97, 104-105,112-113.
R.M. Schuster, Cold Formed Steel Design Manual, 1975, pp. 57-73, 103-104, 127-128, 248-250, 258-259, 287-293, University of Waterloo Press.
Stanley W. Crawley, M.Arch., and Robert M. Dillon, M.A.Arch., Steel Buildings Analysis and Design, Second Edition, 1977, pp. v-viii, ix-x, 1-48, John Wiley & Sons, US.
Encyclopedia of Trusses, A Guide to Using Trusses, 1998, pp. 1-48.
Design Guide For Cold-Formed Steel Trusses, Dec. 1995, p. 1-18, American Iron and Steel Institute.

* cited by examiner

METAL TRUSS

BACKGROUND

This invention relates generally to metal structural members for use in building construction, and more particularly to metal roof trusses for construction of roof framing for supporting roofs.

A roof truss generally comprises two or more top chord members and a bottom chord member. The ends of the top chords are secured together, and the ends of the bottom chord are connected to the lower, free ends of the top chords for forming the exterior of the roof truss. One or more web members span between and interconnect the top and bottom chords. The web members are secured at their ends to the top chords and to the bottom chord.

In building construction, a plurality of trusses are set out across a building frame. When erected upon the building frame, the bottom chord spans the wall frames of the building and is fixed to the top plate of the wall frames. The sub-roof material is then fastened to the top chords, and ceiling material may be fastened to the bottom chord. The combined load of the roof trusses, and the roofing and ceiling material attached to the trusses, is transferred through the outer edges of the trusses to the top plate of the wall frames.

In the past, roof trusses have been constructed of wooden chords and web members. More recently, various types of building systems incorporate metal trusses.

Metal trusses include chord members and web members rolled from metal sheets and formed into substantially rectangular U-shaped or C-shaped channels. The open sides of the chord members are adapted to receive the ends of the other chord members and the web members. The ends of the chords and web members are then fastened together for securing the truss elements in position. The materials cost for metal trusses is competitive with other building materials. Using metal as the material of construction also has a number of other advantages, including relatively stable price, strength, flexibility, durability, light weight, reliability, minimum waste in use, and noncombustability.

A significant problem with the use of metal trusses is the high installed cost. One factor influencing the installed cost of metal trusses is the thermal performance of metal, which is well below that of lumber framing when using standard framing techniques. This is due to the thermal conductivity of metal and the potential for thermal bridging. For example, steel conducts heat more than 300 times faster than wood. The rapid heat flow through steel reduces the insulating value of cavity insulation between 53 and 72%. With respect to metal roof trusses, heat passing through the ceiling material, if present, migrates into the bottom chord. Usually the bottom chord is covered with insulation spread on the attic floor, but heat can still be transferred into the truss at the points where the web members are fastened to the bottom chord. Heat is then conducted by the web members into the attic area and to the top chord at the underside of the roof. The result is a wicking effect whereby heat is transferred out of the building. Special considerations are necessary to reduce the tendency of metal roof trusses to transfer heat in this manner.

As a solution, some builders using metal wall frame construction, but top the building frame with wood roof trusses in order to minimize thermal bridging. However, this defeats the purpose of opting for metal frame construction. Other common solutions to improve energy efficiency include increasing the amount of cavity insulation and applying insulation to the exterior of the metal frame elements to provide a "thermal break" to the heat conducting path. Other means for reducing heat loss include punchouts in the chord members, wide truss spacing, and using thicker gauge steel. All of these approaches add to the cost, installation time and the difficulty of using metal roof trusses.

For the foregoing reasons, there is a need to provide a metal roof truss for use in a metal frame building system that is more energy efficient. Ideally, the new metal roof truss should be inexpensive, light weight, and adapted to mass production.

SUMMARY

According to the present invention, a metal truss is provided comprising a pair of elongated top chord members each having a first end and a second end. The top chord members are connected to each other at the first ends. A first elongated bottom chord member is connected at its ends to the top chord members adjacent the second ends of the top chord members. A second elongated bottom chord member is connected at its ends to the top chord members adjacent the second ends of the top chord members such that the second bottom chord member is spaced below the first bottom chord member. At least one web member is positioned between and interconnecting at least one top chord member and the first bottom chord member. One end of the web member is connected to the at least one top chord member and the other end of the web member is connected to the first bottom chord member.

Also according to the present invention, a metal frame building system is provided including a building frame comprising a plurality of wall frames having top ends. The building system includes a metal truss comprising a pair of elongated top chord members each having a first end and a second end. The top chord members are connected to each other at the first ends. A first elongated bottom chord member is connected at its ends to the top chord members adjacent the second ends of the top chord members. A second elongated bottom chord member is connected at its ends to the top chord members adjacent the second ends of the top chord members such that the second bottom chord member is spaced below the first bottom chord member. At least one web member is positioned between and interconnecting at least one top chord member and the first bottom chord member. One end of the web member is connected to the at least one top chord member and the other end of the web member is connected to the first bottom chord member. The plurality of trusses are adapted to be erected upon the building system frame such that the second bottom chord member spans the wall frames and is connected to the top ends of the respective wall frames.

Further according to the present invention, a building comprises a frame including a plurality of wall frames, each of the wall frames having a top end. A metal truss comprises a pair of elongated top chord members each having a first end and a second end and connected to each other at the first end. A first elongated bottom chord member is connected at its ends to the top chord members adjacent the second ends of the top chord members. A second elongated bottom chord member is connected at its ends to the top chord members adjacent the second ends of the top chord members such that the second bottom chord member is spaced from the first bottom chord member. At least one web member is positioned between and interconnecting at least one top chord member and the first bottom chord member. One end of the web member is connected to the at least one top chord member and the other end of the web member connected to the first bottom chord member. A plurality of the metal trusses are erected upon the frame such that the second bottom chord member spans at least two of the wall frames and is connected to the top ends of the respective wall frames. Roof material is fastened to the top chord members.

Still further according to the present invention, a metal truss is provided comprising a plurality of elongated top chord members connected to each other end to end so that the connected top chord members have two free ends. A first elongated bottom chord member is connected at its ends to the top chord members adjacent the free ends of the connected top chord members. A second elongated bottom chord member is connected at its ends to the top chord members adjacent the free ends of the connected top chord members such that the second bottom chord member is spaced from the first bottom chord member. At least one web member is positioned between and interconnecting at least one top chord member and the first bottom chord member. One end of the web member is connected to the at least one top chord member and the other end of the web member connected to the first bottom chord member.

According to another embodiment of the present invention, a metal truss is provided comprising a pair of elongated top chord members connected together at their first ends, a first elongated bottom chord member, and means for connecting the first bottom chord member to the top chord members adjacent the second ends of the top chord members. Means are also provided for connecting a second elongated bottom chord member to the first bottom chord member such that the second bottom chord member is spaced from the first bottom chord member. At least one web member is positioned between and interconnecting at least one top chord member and the first bottom chord member. One end of the web member is connected to the at least one top chord member and the other end of the web member is connected to the first bottom chord member.

Also according to the other embodiment of the present invention, a metal frame building system is provided including a plurality of wall frames having top ends. The building system includes a metal truss comprising a pair of elongated top chord members connected together at their first ends, a first elongated bottom chord member, and means for connecting the first bottom chord member to the top chord members adjacent the second ends of the top chord members. Means are also provided for connecting a second elongated bottom chord member to the first bottom chord member such that the second bottom chord member is spaced from the first bottom chord member. At least one web member is positioned between and interconnecting at least one top chord member and the first bottom chord member. One end of the web member is connected to the at least one top chord member and the other end of the web member is connected to the first bottom chord member. A plurality of trusses are adapted to be erected upon the building system frame such that the first bottom chord member spans at least two of the wall frames and is connected to the top ends of the respective wall frames, and the ends of the second bottom chord member extend between the inner surfaces of the wall frames.

Further according to the other embodiment of the present invention, a building comprises a frame including a plurality of wall frames, each of the wall frames having a top end. A metal truss comprises a pair of elongated top chord members connected together at their first ends, a first elongated bottom chord member, and means for connecting the first bottom chord member to the top chord members adjacent the second ends of the top chord members. Means are also provided for connecting a second elongated bottom chord member to the first bottom chord member such that the second bottom chord member is spaced from the first bottom chord member. At least one web member is positioned between and interconnecting at least one top chord member and the first bottom chord member. One end of the web member is connected to the at least one top chord member and the other end of the web member is connected to the first bottom chord member. A plurality of trusses are adapted to be erected upon the frame such that the first bottom chord member spans at least two of the wall frames and is connected to the top ends of the respective wall frames, and the ends of the second bottom chord member extend between the inner surfaces of the wall frames. Roof material fastened to the top chord members.

Still further according to another embodiment of the present invention, a metal truss is provided comprising a plurality of elongated top chord members, the top chord members connected to each other end to end so that the connected top chord members have two free ends. Means are provided for connecting a first elongated bottom chord member to the top chord members adjacent the second ends of the top chord members. Means are also provided for connecting a second elongated bottom chord member to the first bottom chord member such that the second bottom chord member is spaced from the first bottom chord member. At least one web member positioned between and interconnecting at least one top chord member and the first bottom chord member. One end of the web member is connected to the at least one top chord member and the other end of the web member is connected to the first bottom chord member.

BRIEF DESCRIPTION OF THE DRAWINGS

For a more complete understanding of the present invention, reference should now be had to the embodiment shown in the accompanying drawings and described below. In the drawings.

DESCRIPTION

Certain terminology is used herein for convenience only and is not to be taken as a limitation on the present invention. For example, words such as "upper," "lower," "left," "right," "horizontal," "vertical," "upward," and "downward" merely describe the configuration shown in the Figures. Indeed, the components may be oriented in any direction and the terminology, therefore, should be understood as encompassing such variations unless specified otherwise.

Figure 1:
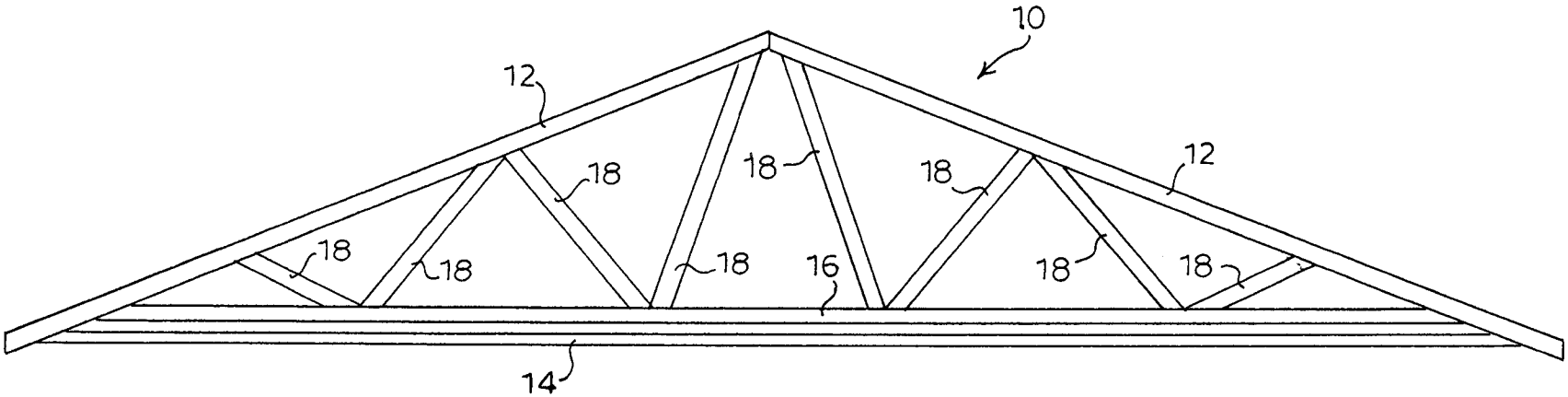
FIG. 1 is a schematic view of a roof truss assembly according to the present invention.

Referring now to the drawings, wherein like reference numerals designate corresponding or similar elements throughout the several views, FIG. 1 shows an embodiment of a roof truss assembly according to the present invention, generally designated at 10. The roof truss assembly 10 comprises several structural truss members, including a pair of top, or upper, chord members 12, a pair of spaced bottom, or lower, chord members 14, 16, and web members 18. Adjacent upper ends of the top chord members 12 are secured together to form an apex joint. In this embodiment, the ends of both bottom chord members 14, 16 are secured adjacent to the lower ends of the top chord members 12. The top chord members 12 and the lower bottom chord member 14 form a triangle, with the lower bottom chord member 14 as the base and the top chord members 12 forming the sides of the triangle.

It is well known in the art that there are a number of roof truss profiles in addition to the triangular truss assembly 10 depicted in FIG. 1. We do not intend to limit the application of the present invention to a triangular truss profile. Rather, the present invention is applicable to all such truss profiles.

The web members 18 extend between the top chord members 12 and the upper bottom chord member 16. The opposite ends of the web members 18 are secured to the top chord members 12 and upper bottom chord member 16 for rigidifying the roof truss assembly 10. Eight web members 18 are shown in FIG. 1. It is understood that we do not intend to limit the application of the present invention to a roof truss assembly 10 having a predetermined position and number of web members 18. The number and the position of web members 18 will vary as necessary depending upon the size of a building and the lengths of the chord members 12, 14, 16 in order to provide the required structural strength with an acceptable safety factor.

Each of the truss members is formed from a strip or sheet of metal. The preferred material of construction is steel. However, the present invention is not limited to steel, and other metals such as aluminum, copper, magnesium, or other suitable metal may be appropriate. The scope of the invention is not intended to be limited by the materials listed here, but may be carried out using any material which allows the construction and use of the metal roof truss assembly 10 described herein.

Figure 2:
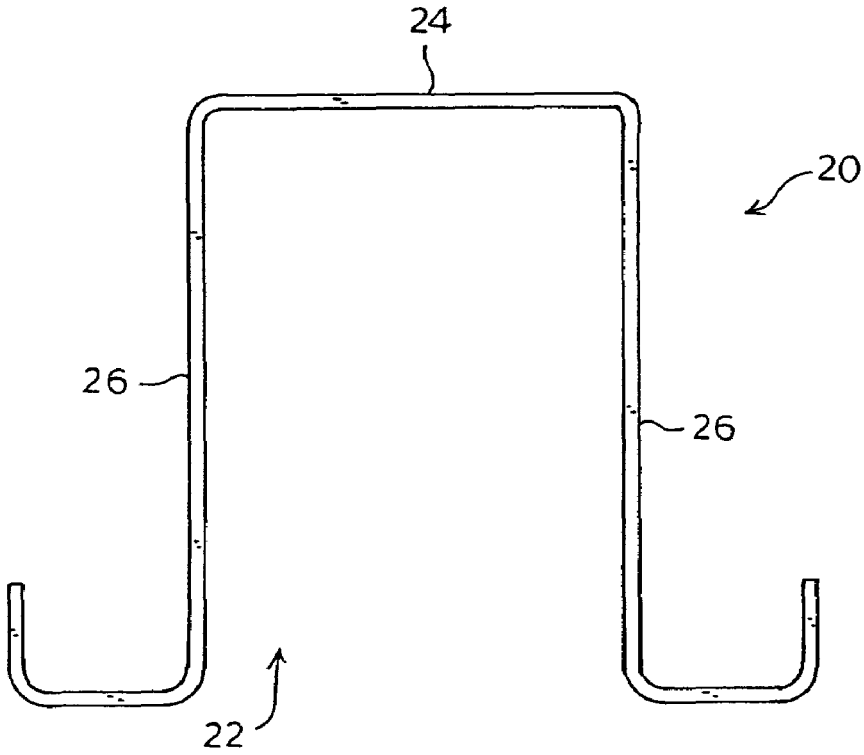
FIG. 2 is an elevational end view of a truss member for use in the truss assembly according to the present invention.

As shown in FIG. 2, a truss member 20 which comprises the roof truss assembly 10 of the present invention is substantially C-shaped or U-shaped, having a web 24 spanning opposed side walls 26 defining a channel 22 section. When assembled (FIG. 1), the open channels of the bottom chord members 14, 16 face upwardly and the open channels of the top chord members 12 face downwardly. Joints are formed where the chord members 12, 14, 16 and web members 18 intersect one another. The joints can be secured using fasteners (not shown), such as metal screws, bolts and nuts, rivets, or any combination thereof. For this purpose, aligned holes may be punched or drilled through the truss members during production. A short connecting plate (not shown) may also be fitted to the chord members 12, 14, 16 and web members 18 on each side of a joint and fastened together with the chord members 12, 14, 16 and web members 18 to form a reinforced joint. Alternatively, the truss members may be joined by welding, soldering, and the like.

The truss members can all be produced on-site from coils of sheet metal using a portable roll forming machine, as is known in the art. Features for joining the truss members may be provided by the forming machine, including holes for fasteners. Notches are cut into the side walls 26 a sufficient distance to accommodate intersecting truss members, depending upon the angle at which the truss members meet each other, allowing a portion of one end of a truss member to be fitted within another truss member. All of the truss members can be formed with a common section to simplify production. Additionally, service holes may be provided in the structural member to accommodate electrical wiring or other utilities.

Figure 3:
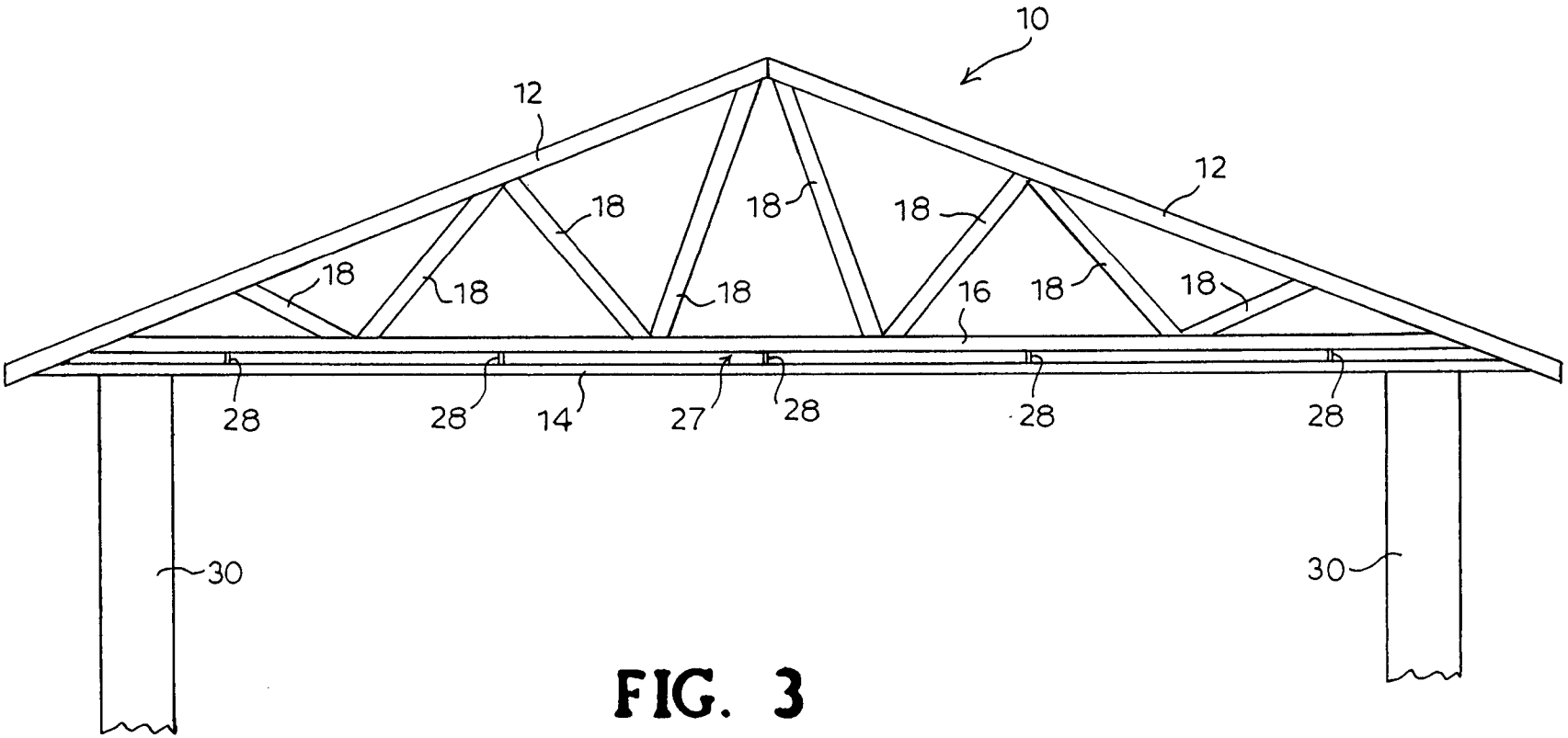
FIG. 3 is a schematic view of the roof truss assembly shown in FIG. 1 positioned on wall frames the bottom portion of which have been cut-away.
Figure 3A:
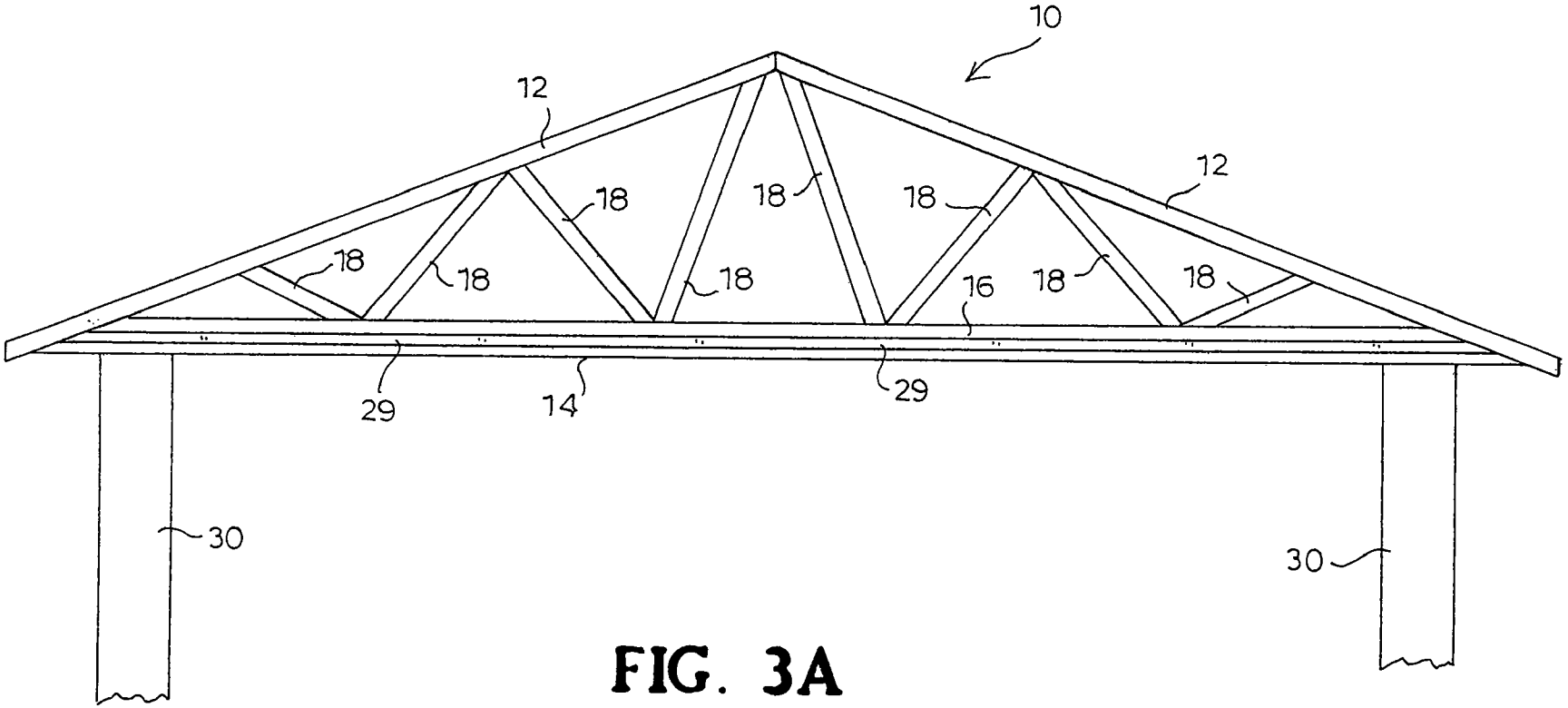
FIG. 3A is a schematic view of the roof truss assembly as shown in FIG. 3 including insulation between the bottom chord members.

In accordance with the present invention, the lower bottom chord member 14 is separated from the upper bottom chord 16. As a result of this arrangement, there is no direct thermal path from the lower bottom chord member 14 to the web members 18 of the truss assembly 10. Moreover, the air space 27 between the bottom chord members 14, 16 serves as an insulator. The air space 27 between the bottom chord members 14, 16 can be insulated to further enhance thermal performance. FIG. 3A shows a length of insulating material 29 held between the lower bottom chord member 14 and the upper bottom chord member 16.

In building construction, a plurality of truss assemblies 10 are set out across a building frame. As seen in FIG. 3, the lower bottom chord 14 spans the wall frames 30 of the building and is fixed to the top plate (not shown) of the wall frames 30. Ceiling material (not shown) may be attached directly to the lower bottom cord 14. Tensile elements 28, schematically shown in FIG. 3, may be provided between the bottom chord members 14, 16 where necessary to support the weight of the ceiling material. The tensile elements 28 are spaced from the points on the truss assembly 10 where the web members 18 are fastened to the upper bottom chord 16 to minimize the potential for thermal bridging. Preferably, the tensile elements 28 are formed from a material having a low thermal conductivity.

Figure 4:
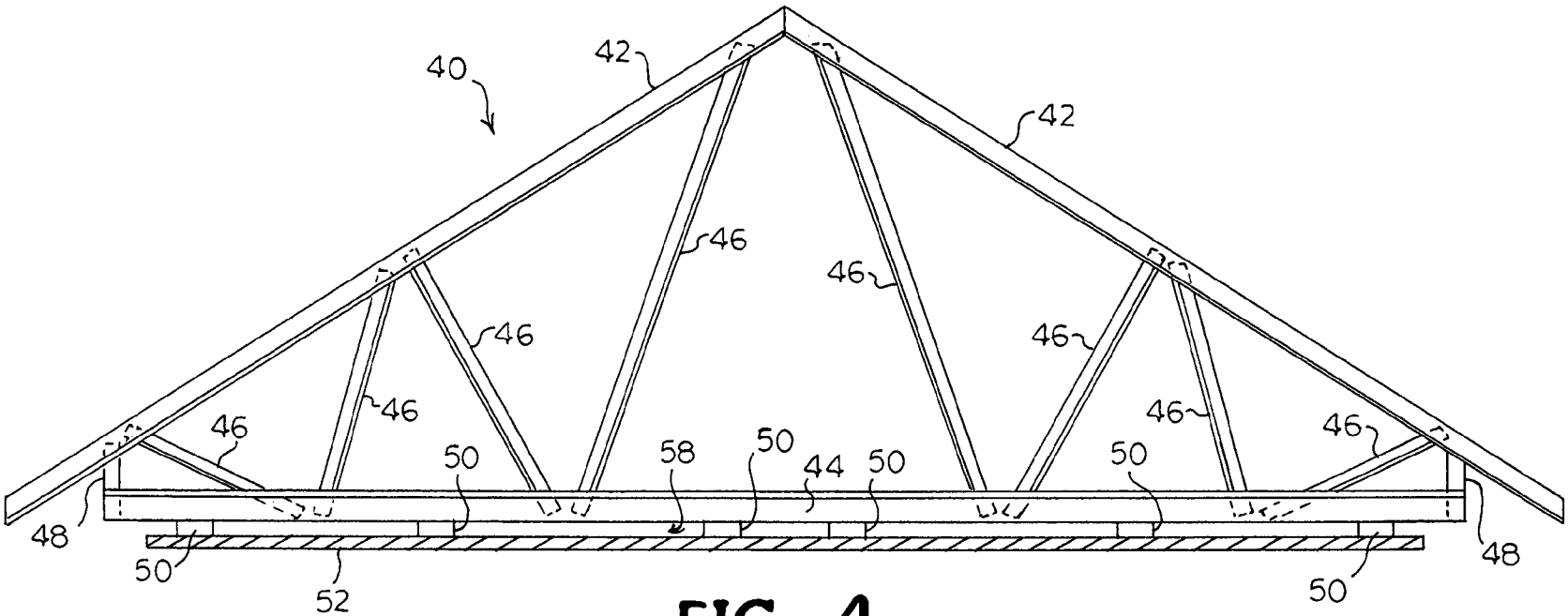
FIG. 4 is a schematic view of another embodiment of a roof truss assembly according to the present invention.

Another embodiment of the roof truss assembly according to the present invention is shown in FIG. 4 and generally designated at 40. In this embodiment, the roof truss assembly 40 comprises a pair of top chord members 42, a bottom chord member 44 and web members 46. The web members 46 extend between and interconnect the top chord members 42 and the bottom chord member 44. A vertically-positioned heel truss 48 is fastened between each end of the bottom chord member 44 and the free ends of the top chord members 42. As noted above, the present invention is not limited to a triangular truss profile, but rather is applicable to all known roof truss profiles. Moreover, the number and position of the web members 46 will vary as necessary depending upon the truss profile, the size of a building, and the lengths of the chord members 42, 44, in order to provide the required structural strength with an acceptable safety factor. Thus, the triangular truss profile and the number and position of the web members 46 depicted in FIG. 4 are merely exemplary.

Figure 5:
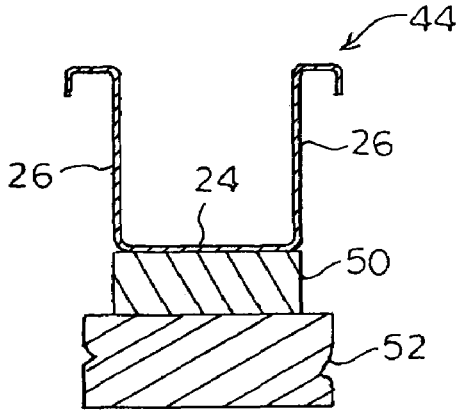
FIG. 5 is a cross-section of a truss member taken along line 5-5 of FIG. 4.

Spacers 50 are positioned along the length of, and fastened to, the bottom chord member 44. The spacers 50 are located away from the points on the truss assembly 40 where the web members 46 are fastened to the bottom chord member 44. A ceiling support 52 is secured to the spacers 50. As seen in FIG. 5, the ceiling support 52 may be slightly wider than the web 24 of the bottom chord member 44. Ceiling material 54 may be attached to the ceiling support 52. The spacers 50 and ceiling support 52 can be formed from any material as long as the combination, along with the means for fastening the ceiling support 52 through the spacer 50 to the bottom chord member 44, is sufficiently strong to support the ceiling support 52 and ceiling material 54. For example, wood, fiberboard, cardboard, plastic, and the like, are all suitable materials for the spacers 50 and ceiling support 52. Preferably, the spacers 50 have a low thermal conductivity. In keeping with the invention, the spacers 50 function to provide an insulating air space 58 between the bottom chord member 44 and the ceiling support 52 (FIG. 3), which minimizes the potential for thermal bridging.

Figure 6:
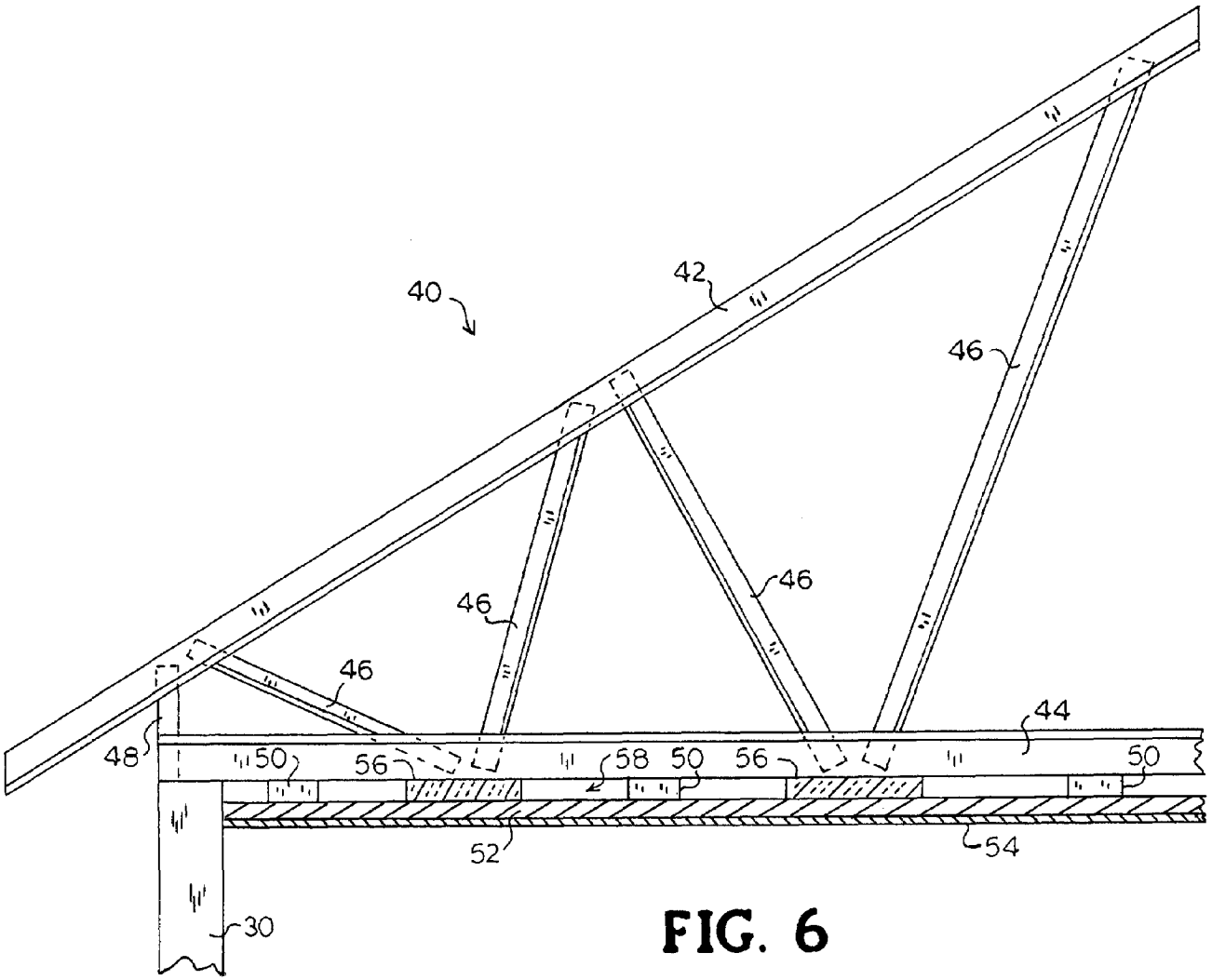
FIG. 6 is a schematic view of one half of the truss assembly shown in FIG. 4 positioned on a wall frame the bottom portion of which has been cut-away.

Referring to FIG. 6, one side of a truss assembly 40 according to the second embodiment of the present invention is shown in position on a wall frame 30. The bottom chord 44 spans the wall frames 30 (only one of which is shown in FIG. 6) of the building and is fixed to the top plate of the wall frames 30. The ends of the ceiling support 54 extend between the inner surfaces of the wall frames 30. Ceiling material 54 is attached directly to the ceiling support 52. Optionally, insulating material 56 may be disposed in the air space 58. For example, as seen in FIG. 6, a length of insulating material 56 is placed between the ceiling support 52 and the bottom chord 44 where the web members 46 attach to the bottom chord member 44.

The thermal performance of the roof truss assembly of the present invention is significantly improved over conventional metal trusses. Separation of the lower bottom chord member or ceiling support from the bottom chord member connected to the web members provides an insulating air space between the ceiling and the bottom chord member and eliminates any direct thermal path from the ceiling to the bottom chord member and the web members of the truss assembly. Although the air space 27 can be insulated to further enhance thermal performance, the improvement in thermal performance can be achieved without the additional insulating material, or the use of insulating material as a thermal break. Moreover, a truss configuration according to the present invention allows the use of light gauge metal, preferably having a thickness of less than about 1.2 mm. For example, standard light gauge metal could be used, such as 12, 14, or 16 gauge.

Although the present invention has been shown and described in considerable detail with respect to a particular exemplary embodiments thereof, it should be understood by those skilled in the art that we do not intend to limit the invention to the embodiment since various modifications, omissions and additions may be made to the disclosed embodiments without materially departing from the novel teachings and advantages of the invention, particularly in light of the foregoing teachings. For example, the truss profile and the number and position of the truss members may be any of a number of arrangements known in the art. Accordingly, we intend to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a crew may be equivalent structures.

We claim:

1. A metal truss, comprising:

a pair of elongated top chord members each having a first end and a second end, the top chord members connected to each other at the first end;

a first elongated bottom chord member, the ends of the first bottom chord member fixed directly to the top chord members adjacent the second ends of the top chord members;

a second elongated bottom chord member, the ends of the second bottom chord member fixed directly to the top chord members adjacent the second ends of the top chord members such that the second bottom chord member is spaced from the first bottom chord member defining a space between the first bottom chord member and the second bottom chord member; and at least one web member positioned between and interconnecting at least one top chord member and the first bottom chord member, one end of the web member connected to the at least one top chord member and the other end of the web member connected to the first bottom chord member.

2. A metal truss as recited in claim 1, wherein the ends of the second bottom chord member connect with the second ends of the top chord members at a point spaced from the second ends of the top chord members.

3. A metal truss as recited in claim 1, wherein the connected top chord members form an apex of an angular shape, and with the second bottom chord member, form a triangle.

4. A metal truss as recited in claim 1, wherein the thickness of the metal comprising the top and bottom chord members and the at least one web member is less than about 1.2 mm.

5. A metal truss as recited in claim 1, further comprising at least one tensile element connected between the first bottom chord member and the second bottom chord member, wherein the point of connection of the tensile element to the first bottom chord member is spaced from the point of connection of the at least one web member to the first bottom chord member.

6. A metal truss as recited in claim 1, further comprising insulating material disposed between the first bottom chord member and the second bottom chord member at the point of connection of the at least one web member to the first bottom chord member.

7. A metal frame building system including a frame comprising a plurality of wall frames, each of the wall frames having a top end, the building system comprising:

a plurality of metal trusses, each of the trusses comprising a pair of elongated top chord members each having a first end and a second end, the top chord members connected to each other at the first end;

a first elongated bottom chord member, the ends of the first bottom chord member fixed directly to the top chord members adjacent the second ends of the top chord members;

a second elongated bottom chord member, the ends of the second bottom chord member fixed directly to the top chord members adjacent the second ends of the top chord members such that the second bottom chord member is spaced from the first bottom chord member defining a space between the first bottom chord member and the second bottom chord member; and at least one web member positioned between and interconnecting at least one top chord member and the first bottom chord member, one end of the web member connected to the at least one top chord member and the other end of the web member connected to the first bottom chord member, wherein the plurality of trusses are adapted to be erected upon the building system frame such that the second bottom chord member spans at least two of the wall frames and is connected to the top ends of the respective wall frames.

8. A building system as recited in claim 7, wherein the ends of the second bottom chord member are fixed to the second ends of the top chord members at a point spaced from the second ends of the top chord members.

9. A building system as recited in claim 7, wherein the thickness of the metal comprising the top and bottom chord members and the at least one web member is less than about 1.2 mm.

10. A building system as recited in claim 7, further comprising at least one tensile element connected between the first bottom chord member and the second bottom chord member, wherein the point of connection of the tensile element to the first bottom chord member is spaced from the point of connection of the at least one web member to the first bottom chord member.

11. A building system as recited in claim 7, further comprising insulating material disposed between the first bottom chord member and the second bottom chord member at the point of connection of the at least one web member to the first bottom chord member.

12. A building, comprising:

a frame including a plurality of wall frames, each of the wall frames having a top end;

a plurality of metal trusses, each of the trusses comprising a pair of elongated top chord members each having a first end and a second end, the top chord members connected to each other at the first end, a first elongated bottom chord member, the ends of the first bottom chord member fixed directly to the top chord members adjacent the second ends of the top chord members, a second elongated bottom chord member, the ends of the second bottom chord member fixed directly to the top chord members adjacent the second ends of the top chord members such that the second bottom chord member is spaced from the first bottom chord member defining a space between the first bottom chord member and the second bottom chord member, and at least one web member positioned between and interconnecting at least one top chord member and the first bottom chord member, one end of the web member connected to the at least one top chord member and the other end of the web member connected to the first bottom chord member, wherein the plurality of trusses are erected upon the frame such that the second bottom chord member spans at least two of the wall frames and is connected to the top ends of the respective wall frames; and roof material fastened to the top chord members.

13. A building as recited in claim 12, wherein the ends of the second bottom chord member are fixed to the second ends of the top chord members at a point spaced from the second ends of the top chord members.

14. A building as recited in claim 12, wherein the thickness of the metal comprising the top and bottom chord members and the at least one web member is less than about 1.2 mm.

15. A building as recited in claim 12, further comprising at least one tensile element connected between the first bottom chord member and the second bottom chord member, wherein the point of connection of the tensile element to the first bottom chord member is spaced from the point of connection of the at least one web member to the first bottom chord member.

16. A building as recited in claim 12, further comprising insulating material disposed between the first bottom chord member and the second bottom chord member at the point of connection of the at least one web member to the first bottom chord member.

17. A metal truss, comprising:

a plurality of elongated top chord members, the top chord members connected to each other end to end so that the connected top chord members have two free ends;

a first elongated bottom chord member, the ends of the first bottom chord member fixed directly to the top chord members adjacent the free ends of the connected top chord members;

a second elongated bottom chord member, the ends of the second bottom chord member fixed directly to the top chord members adjacent the free ends of the connected top chord members such that the second bottom chord member is spaced from the first bottom chord member defining a space between the first bottom chord member and the second bottom chord member; and at least one web member positioned between and interconnecting at least one top chord member and the first bottom chord member, one end of the web member connected to the at least one top chord member and the other end of the web member connected to the first bottom chord member.

* * * * *